United States Patent [19]

Etemad et al.

[11] Patent Number: 4,854,831

[45] Date of Patent: Aug. 8, 1989

[54] SCROLL COMPRESSOR WITH PLURAL DISCHARGE FLOW PATHS

[75] Inventors: Shahrokh Etemad, E. Syracuse; Donald Yannascoli, Fayetteville, both of N.Y.; Michael Hatzikazakis, Greenville, S.C.

[73] Assignee: Carrier Corporation, Syracuse, N.Y.

[21] Appl. No.: 206,991

[22] Filed: Jun. 8, 1988

Related U.S. Application Data

[63] Continuation of Ser. No. 125,918, Nov. 27, 1987, abandoned.

[51] Int. Cl.[4] ..... F04B 39/06; F04C 18/04; F04C 29/04

[52] U.S. Cl. ..... 417/366; 418/15; 418/55; 418/DIG. 1

[58] Field of Search ..... 418/15, 55, DIG. 1, 418/86; 417/366, 369, 410

[56] References Cited

U.S. PATENT DOCUMENTS

| | | | |
|---|---|---|---|
| 3,191,403 | 6/1965 | Ladusaw | 418/86 |
| 4,365,941 | 12/1982 | Tojo et al. | 417/410 |
| 4,389,171 | 6/1983 | Eber et al. | 418/15 |
| 4,497,615 | 2/1985 | Griffith | 418/15 |
| 4,696,628 | 9/1987 | Kimura et al. | 418/15 |

FOREIGN PATENT DOCUMENTS

| | | | |
|---|---|---|---|
| 57-70984 | 5/1982 | Japan | 418/DIG. 1 |
| 61-112795 | 5/1986 | Japan | 418/DIG. 1 |

*Primary Examiner*—John J. Vrablik
*Attorney, Agent, or Firm*—David J. Zobkiw

[57] ABSTRACT

A high side hermetic scroll compressor passes the discharge gas along the interior of the shell and is thereby cooled prior to being subjected to a centrifugal separation to remove the oil before being discharged from the compressor. The separated oil is returned to the sump via a fluid path isolated from the discharge gas.

4 Claims, 17 Drawing Sheets

SCROLL COMPRESSOR WITH PLURAL DISCHARGE FLOW PATHS

This application is a continuation of application Ser. No. 125,918, filed Nov. 27, 1987, abandoned.

BACKGROUND OF THE INVENTION

Scroll machines can be used to compress, expand or pump fluids and include two scroll members each of which has a circular end plate and a spiral or involute wrap. The scroll members are maintained angularly and radially offset so that both wraps interfit to make either a plurality of line contacts or are spaced by minimum clearances between the wraps to thereby define at least one pair of fluid pockets or chambers. One scroll member is stationary and the other orbits through an eccentric shaft and an antirotation coupling. The relative orbital motion of the two scroll members shifts the line contacts or minimum clearances along the curved surfaces of the wraps so that the trapped volumes in the fluid pockets change in volume. The trapped volumes can increase or decrease depending upon the direction of orbiting motion. Because several trapped volumes generally exist at the same time, several line contact or minimum clearance points also exist at the same time with each moving along the wraps with movement being towards the center or discharge port in the case of a compressor. In the case of a compressor, the compressed gas produces a force tending to axially separate the scroll members resulting in high thrust loads and tip leakage. Additionally, different designs are normally required for horizontal and vertical units. The inherent configuration of scroll machines is tall/long and thin. Thus, from the system unit size and packaging configurations, it is generally desirable to mount the scroll machines horizontally.

Conventionally, in vertical scroll compressors, the motor is mounted beneath the scroll mechanism with the following results: a slightly longer shell; a basic centrifugal pump which requires high lift in order to cross the motor and lubricate the highly loaded bearings: a gravity oil separation mechanism which is orientation sensitive to return the oil to the sump: and a finely metered oil injection system with limited sealing capabilities.

SUMMARY OF THE INVENTION

In the preferred embodiment, a high side scroll compressor which is one in which the interior of the shell is at discharge pressure is sealed by a combination of close tolerance control and oil injection. It is therefore necessary to provide effective oil separation from the discharge gas since the oil provides a lubrication function in addition to sealing. The oil sump is isolated and the oil pumping action takes place due to the centrifugal pumping action of the crankshaft and due to the pressure differential between the oil sump which is at compressor discharge pressure and the interstage pressure(s) at which oil injection into the scrolls takes place. In a vertical orientation, the motor is mounted on top of the scroll which permits the taking advantage of the vortex created at the entry of the discharge tube for centrifugal separation of the oil. In a generally horizontal orientation, the device still operates satisfactorily and the weight bias of the motor is reduced. An angle of at least 15°-20° from horizontal is necessary for a gravity return of the oil to the sump.

It is an object of this invention to provide an orientation insensitive scroll compressor.

It is another object of this invention to provide a scroll compressor which does not require axial or radial seals.

It is a further object of this invention to provide a scroll compressor incorporating close tolerance control and oil injection to provide the sealing function.

It is another object of this invention to provide an axial thrust bearing incorporating a two-stage back pressure control to offset a large portion of the axial loading imparted to the orbiting scroll. These objects, and others as will become apparent hereinafter, are accomplished by the present invention.

Basically, a high side scroll compressor uses oil injection for sealing, for supplying a back pressure bias for offsetting axial loading and for providing lubrication. The oil sump is isolated and at discharge pressure so that a pressure differential provides the motive force for supplying the oil to the bearing surfaces and thereafter to the points of injection. In the vertical orientation, the motor is located above the scroll members and its weight acts in concert with the back-pressure bias to offset axial loading.

BRIEF DESCRIPTION OF THE DRAWINGS

For a fuller understanding of the present invention, reference should be made to the following detailed description thereof taken in conjunction with the accompanying drawings wherein.

DESCRIPTION OF THE PREFERRED EMBODIMENT

Figure 2:
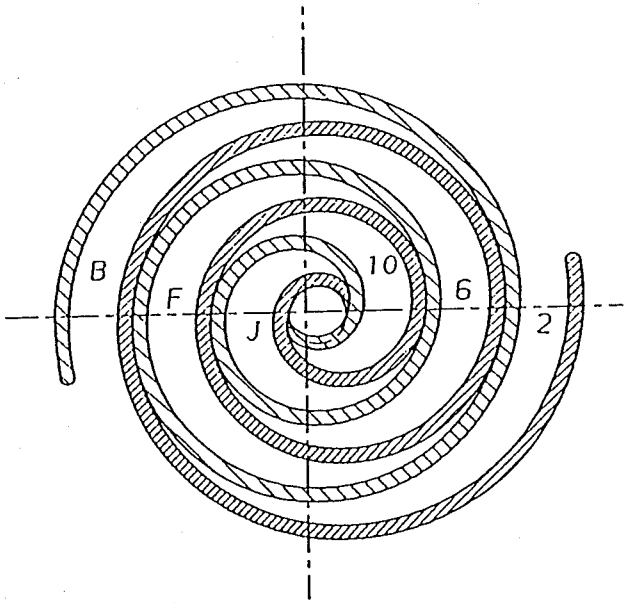
FIGS. 1-4 are schematic views sequentially illustrating the relative positions of the wraps at 90° intervals of orbit.
Figure 1:
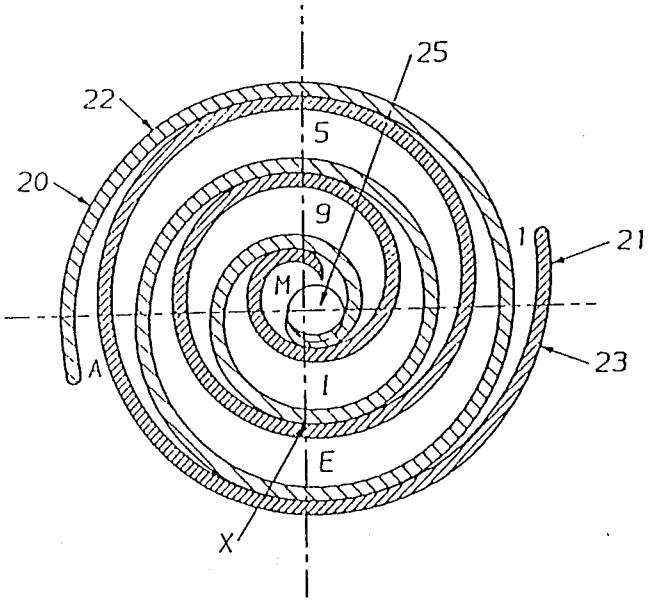
Figure 4:
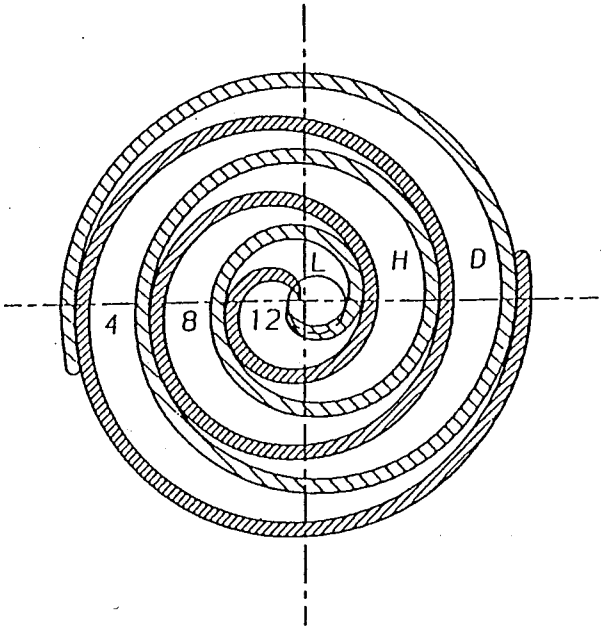
Figure 3:
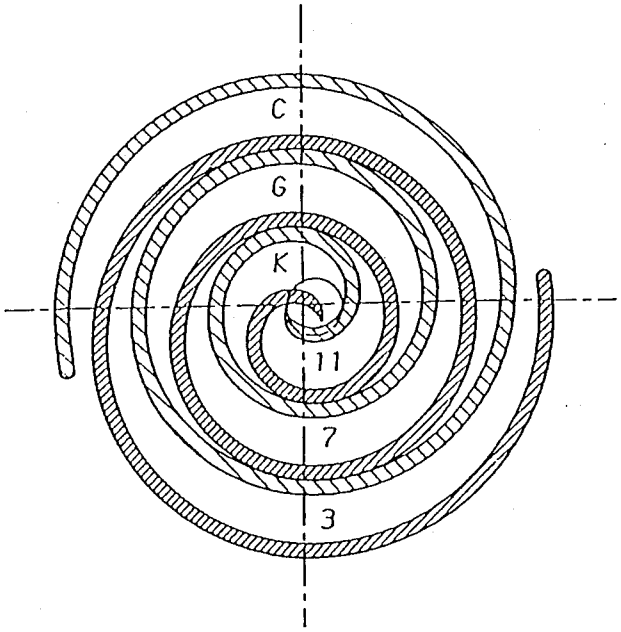

In FIGS. 1-4, the numeral 20 generally indicates the fixed scroll having a wrap 22 and the numeral 21 generally indicates the orbiting scroll having a wrap 23. The chambers labled A-M and 1-12 each serially show the suction, compression and discharge steps with chamber M being the common chamber formed at discharge 25 when the device is operated as a compressor. It will be noted that chambers 4–11 and D–K are each in the form of a helical crescent or lunette approximately 360° in extent with the two ends being points of line contact or minimum clearance between the scroll wraps. If, for example, point X in FIG. 1 represents the point of line contact or of minimum clearance separating chambers 5 and 9 it is obvious that there is a tendency for leakage at this point from the high pressure chamber 9 to the lower pressure chamber 5 and that any leakage represents a loss or inefficiency. To minimize the losses from leakage, it is conventionally necessary to maintain close tolerances, use a positive mechanical tip seal and to run at high speed. However, the present invention uses oil injection to achieve a sealing function. Again referring to FIGS. 1–4, it will be noted that there is a symmetry in that chambers 1–12 correspond to chambers A–L with a difference being that they are on opposite sides of the wraps 22 and 23.

Figure 7:
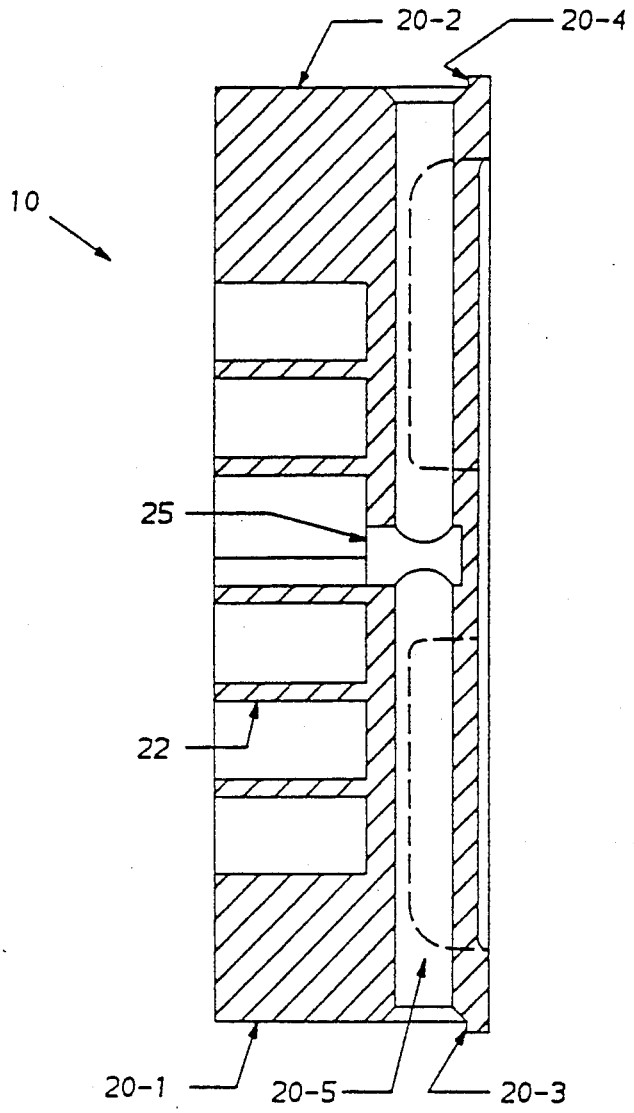
FIG. 7 is a sectional view taken along line 7—7 of FIG. 5.
Figure 8:
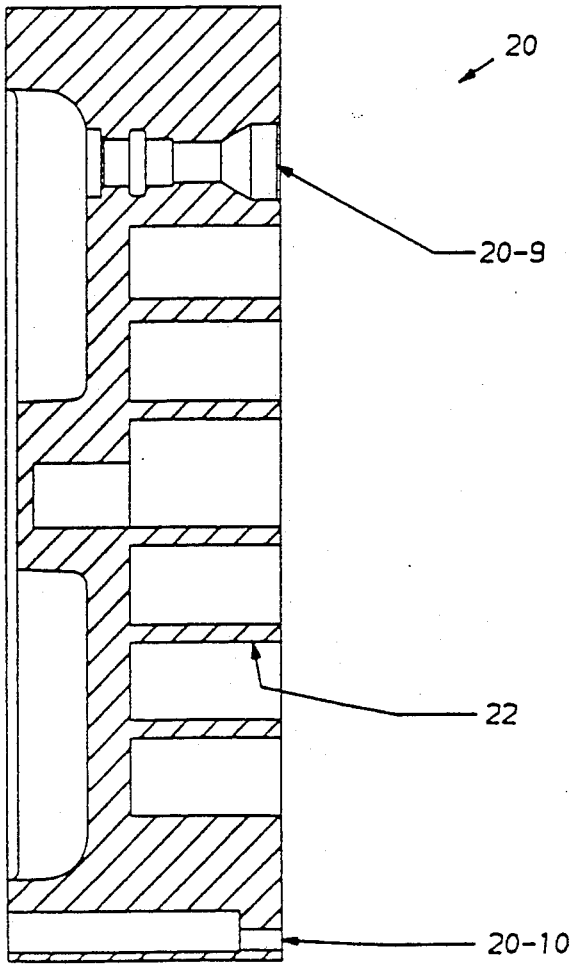
FIG. 8 is a sectional view taken along line 8—8 of FIG. 5.
Figure 9:
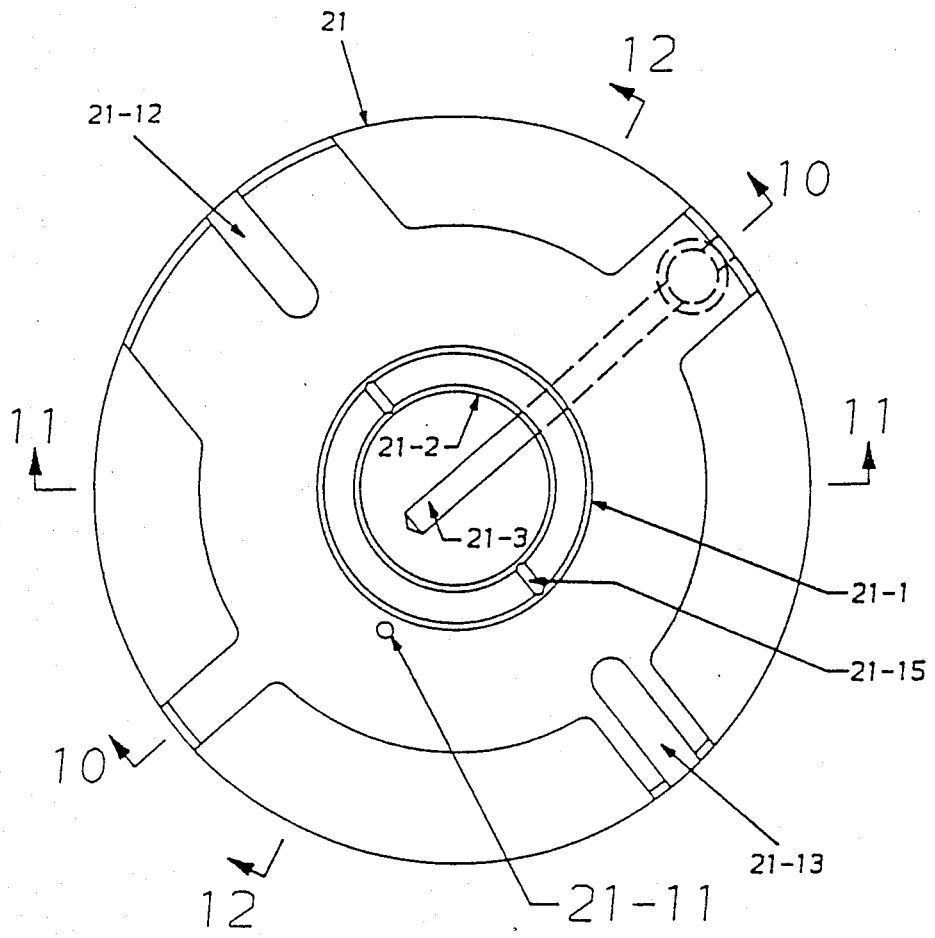
FIG. 9 is a top view of the orbiting scroll.

Referring now to FIGS. 5–8, fixed scroll 20 is generally disc shaped with a spiral shape portion removed to define wrap 22. Two diametrically spaced recessed areas 20-1 and 2, approximately 30° in circumferential extent, are formed in the circumference of fixed scroll 20 so as to leave ledges 20-3 and 4, respectively. As best shown in FIG. 7, diametrical bore 20-5 is fluidly connected to discharge 25 so as to form a part of the discharge flow path and extends between spaced recess areas 20-1 and 2. Bore 20-6 receives the suction tube and serves as an inlet. Bore 20-6 has an internal groove 20-7 formed therein for receiving an O-ring as will be described below. Counterbored axial bores 20-8 are provided for receiving assembly bolts. Axial bore 20-9 receives the oil pickup tube and forms a portion of the lubricant flow path. Axial bores 20-10 form a portion of the oil return flow.

Referring now to FIGS. 9–12, orbiting scroll 21 has a boss 21-1 on the side opposite to wrap 23. Axial bore 21-2 is formed in boss 21-1. Radial bore 21-3 terminates in bore 21-2 and is plugged at the other end by a set screw 26, or other suitable structure. Axial bore 21-4 intersects annular groove 21-14 and terminates in bore 21-3 and together therewith form a portion of the lubricant flow path. Diametrically opposed bores 21-5 and 6 are intersected by axial bores 21-7 and 21-8, respectively. Radial bore 21-9 is formed in boss 21-1 and is intersected by axial bore 21-10. Axial bore 21-11 extends through orbiting scroll 21. Axial bores 21-7, 8, 10 and 11 each terminate at wrap 23 to provide a flow path for the lubricant which provides a seal between wraps 22 and 23. More specifically, bores 21-7 and 8 provide oil between the wraps at lower intermediate pressure and bores 21-10 and 11 provide oil between the wraps at upper intermediate pressure thereby creating a pressure differential with the oil sump. Additionally, this oil at the lower and upper intermediate pressure levels, prior to being supplied between the wraps, acts on the back of orbiting scroll 21 to balance the axial forces tending to separate scrolls 20 and 21. Radial grooves 21-12 and 13 coact with the Oldham coupling in a conventional manner. Diametrically located V-grooves 21-15 provide a lubrication path across boss 21-1 which provides a thrust face for the crankshaft.

Figure 13:
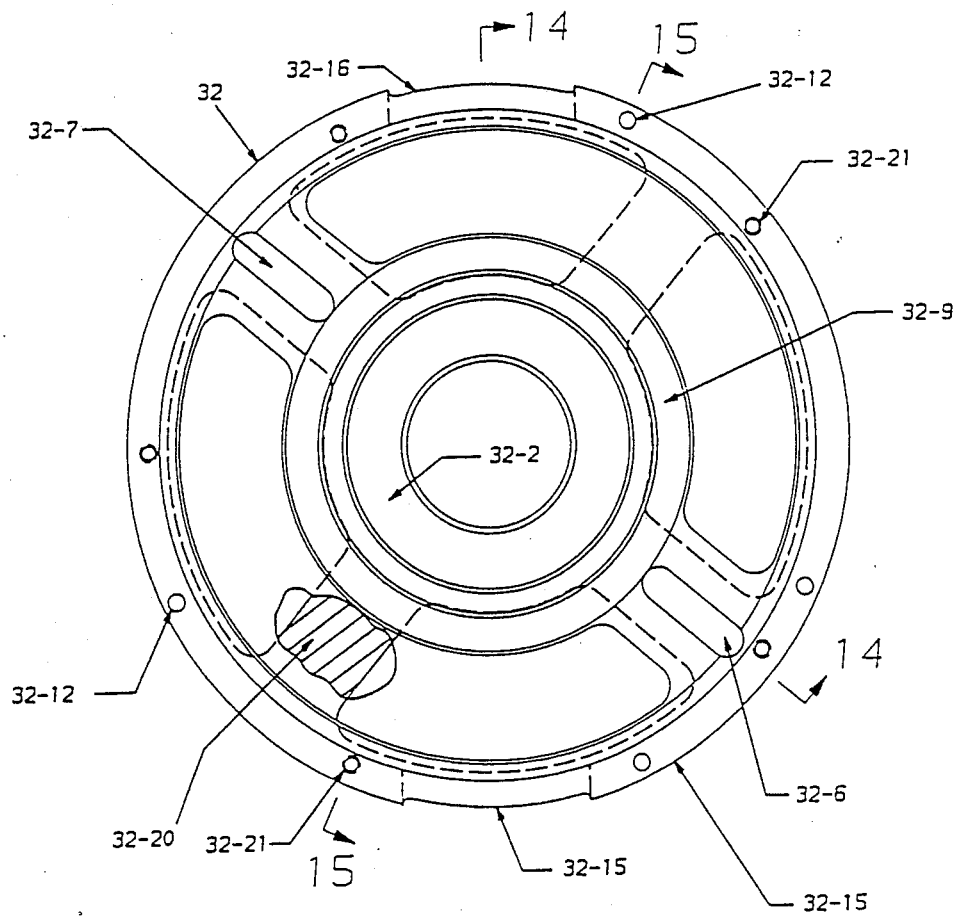
FIG. 13 is a partially cutaway bottom view of a bearing cap.
Figure 14:
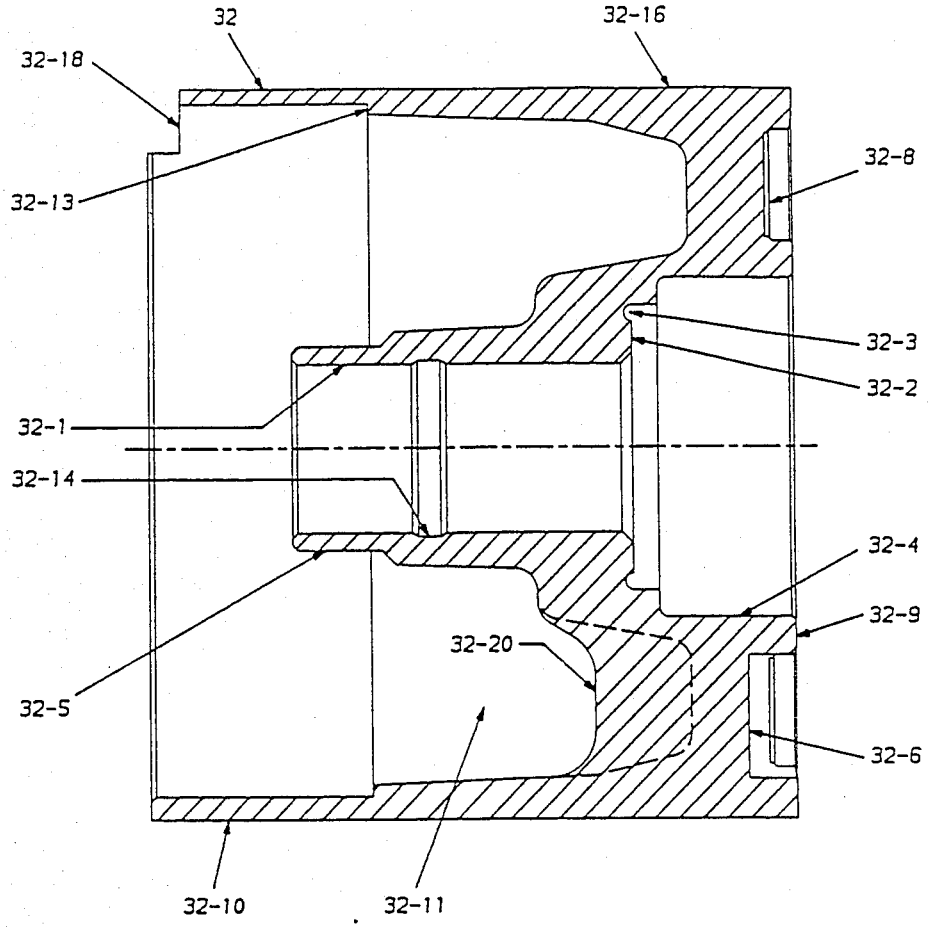
FIG. 14 is a sectional view taken along line 14—14 of FIG. 13.
Figure 15:
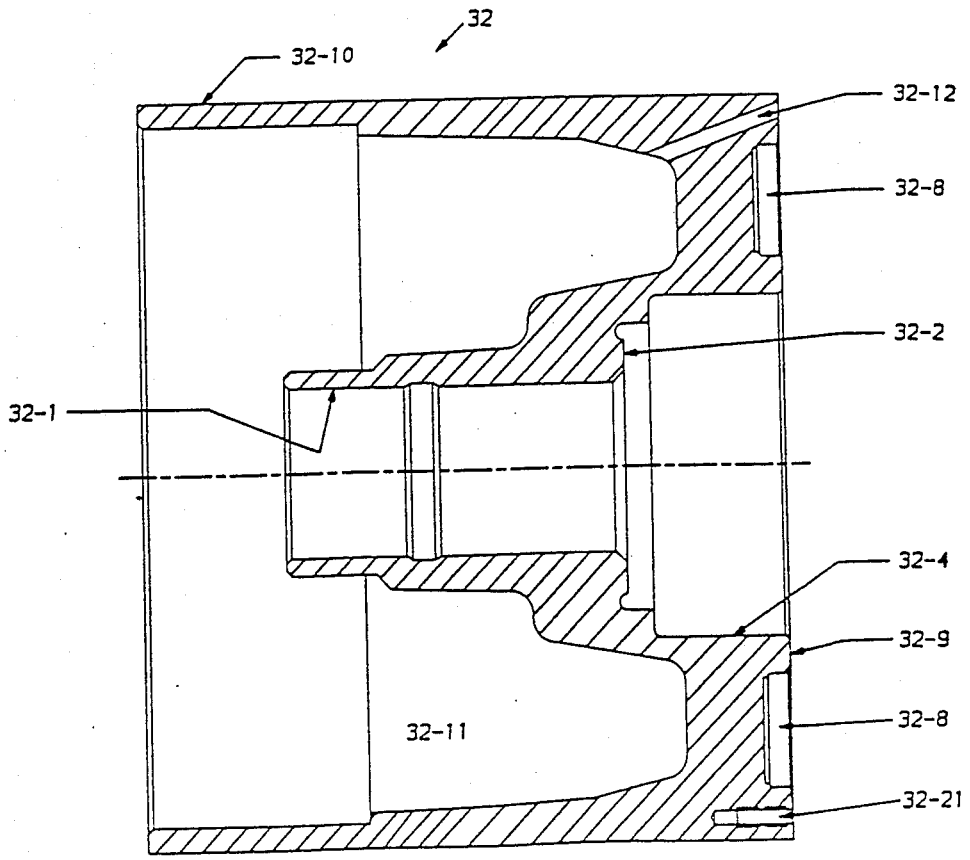
FIG. 15 is a sectional view taken along line 15—15 of FIG. 13.
Figure 16:
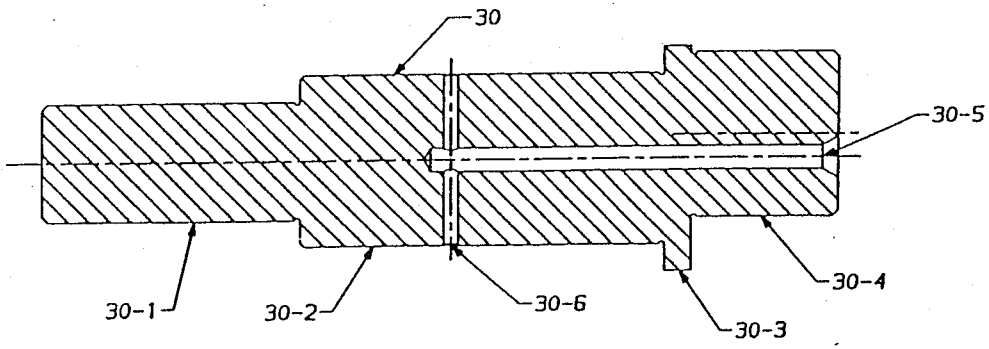
FIG. 16 is an axial sectional view of the crankshaft.

Crankshaft 30, as best shown in FIG. 16, serially includes reduced shaft portion 30-1, main shaft portion 30-2, flange portion 30-3 and eccentric 30-4. Generally axial bore 30-5 terminates in diametrical bore 30-6. Bores 30-5 and 6 form part of the lubricant flow path and define a centrifugal pump. In assembly, crankshaft 30 is received in bearing head 32 which is best illustrated in FIGS. 13–15.

Figure 17:
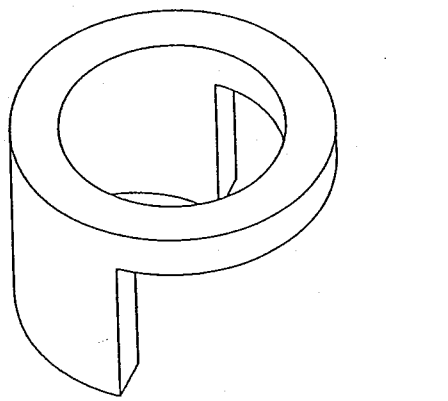
FIG. 17 is a pictorial view of the counterweight.

Main shaft portion 30-2 of crankshaft 30 is supportedly received in bore 32-1 of bearing head or crankcase 32 while reduced shaft portion 30-1 extends outwardly therefrom. Bore 32-1 is located in tubular portion 32-5 and transitions into bore 32-4 with annular shoulder 32-2 and annular recess 32-3 defined therebetween. Shoulder 32-2 controls the upward axial motion of crankshaft 30 which may occur during start up (electromagnetic force) or due to unbalanced gas forces during abnormal operation. Radial slots 32-6 and 7 are formed in annular recess 32-8 in face 32-9 and coact with the Oldham coupling in a conventional manner. Tubular portion 32-5 is surrounded by and coaxial with sleeve portion 32-10 and together therewith forms an annular recess 32-11 for collecting the oil which then drains through passages 32-12. As best shown in FIGS. 13 and 14, the bottom portion of recess 32-11 is separated into four portions by webs 32-20 which are at an angular spacing of 90° and provide rigidity. An annular shoulder 32-13 is formed on the inner wall of sleeve portion 32-10 and supports the stator of the motor. Annular recess 32-14 is formed in bore 32-1 and defines an oil galley providing an oil volume for lubricating the crankshaft and journal surfaces. Diametrically spaced, axially extending, recessed areas 32-15 and 16 are formed in the outer wall of sleeve portion 32-10 and correspond to spaced recessed areas 20-1 and 2 of fixed scroll 20. Radial notches 32-17 and 18 extend through sleeve portion 32-10 at recessed areas 32-15 and 16, respectively. Threaded axial bores 32-21 receive bolts 40. Counterweight 34 which is illustrated in FIG. 17 is secured to flange 30-3 of crankshaft 30 in any suitable fashion and offsets the dynamic unbalance due to the eccentric 30-4, orbiting scroll 21 and Oldham coupling 36.

Figure 18:
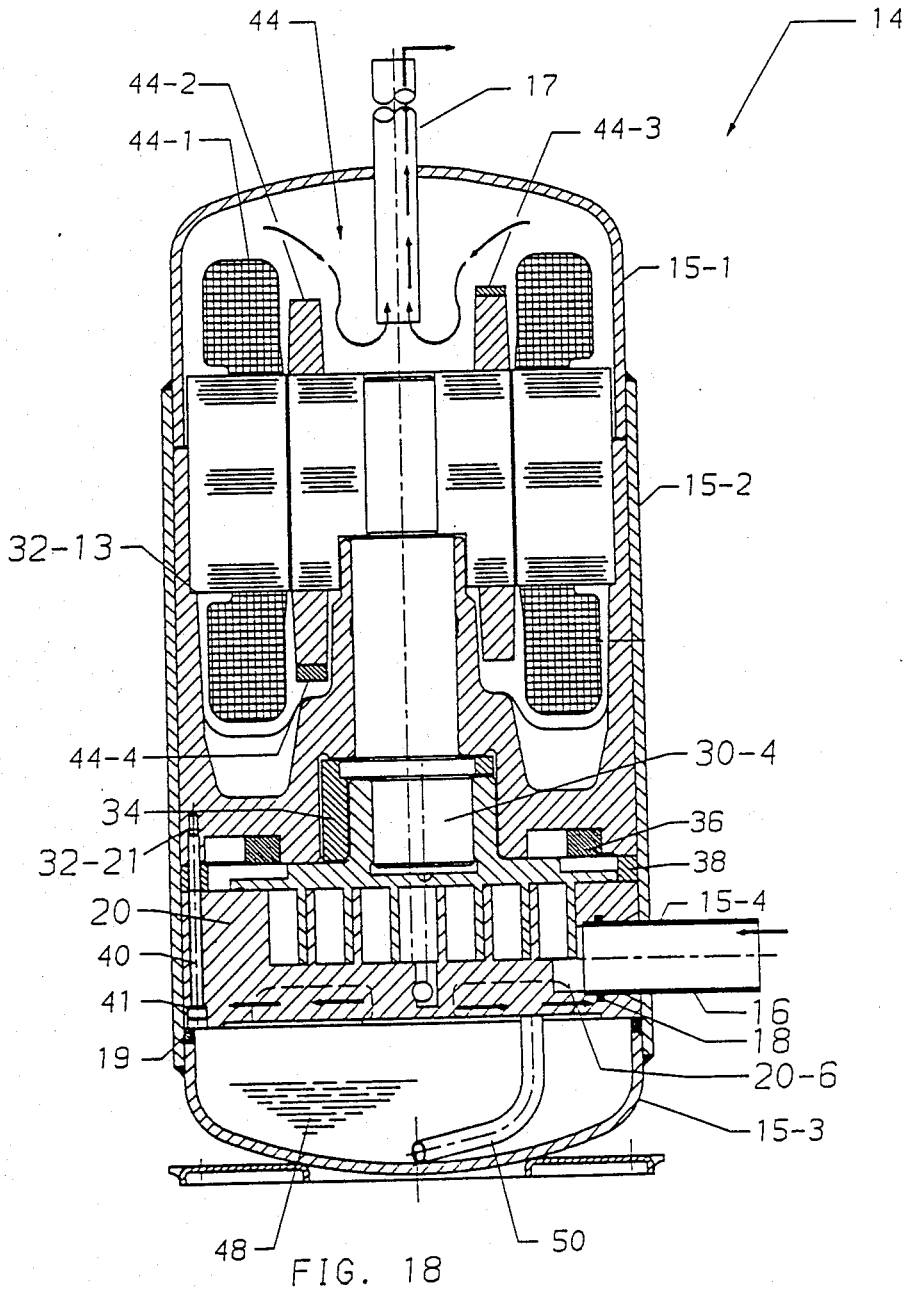
FIG. 18 is a vertical sectional view taken along a section corresponding to line 6—6 of FIG. 5.
Figure 19:
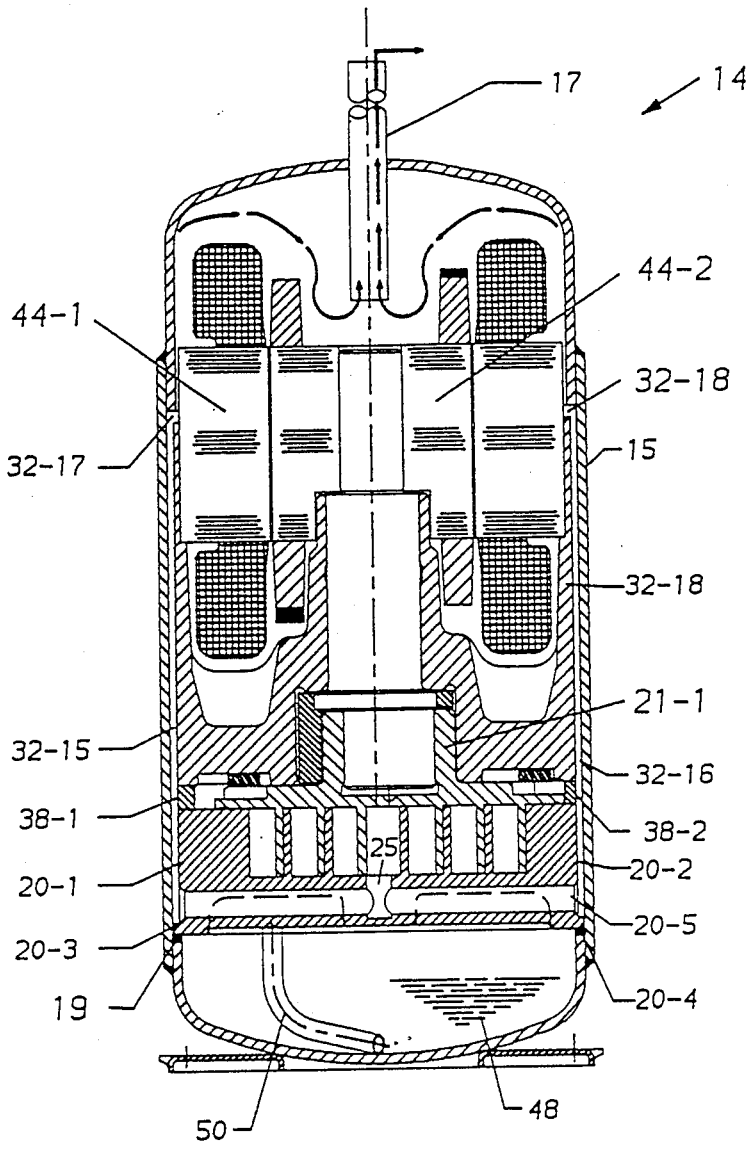
FIG. 19 is a vertical sectional view taken along a section corresponding to line 7—7 of FIG. 5.
Figure 20:
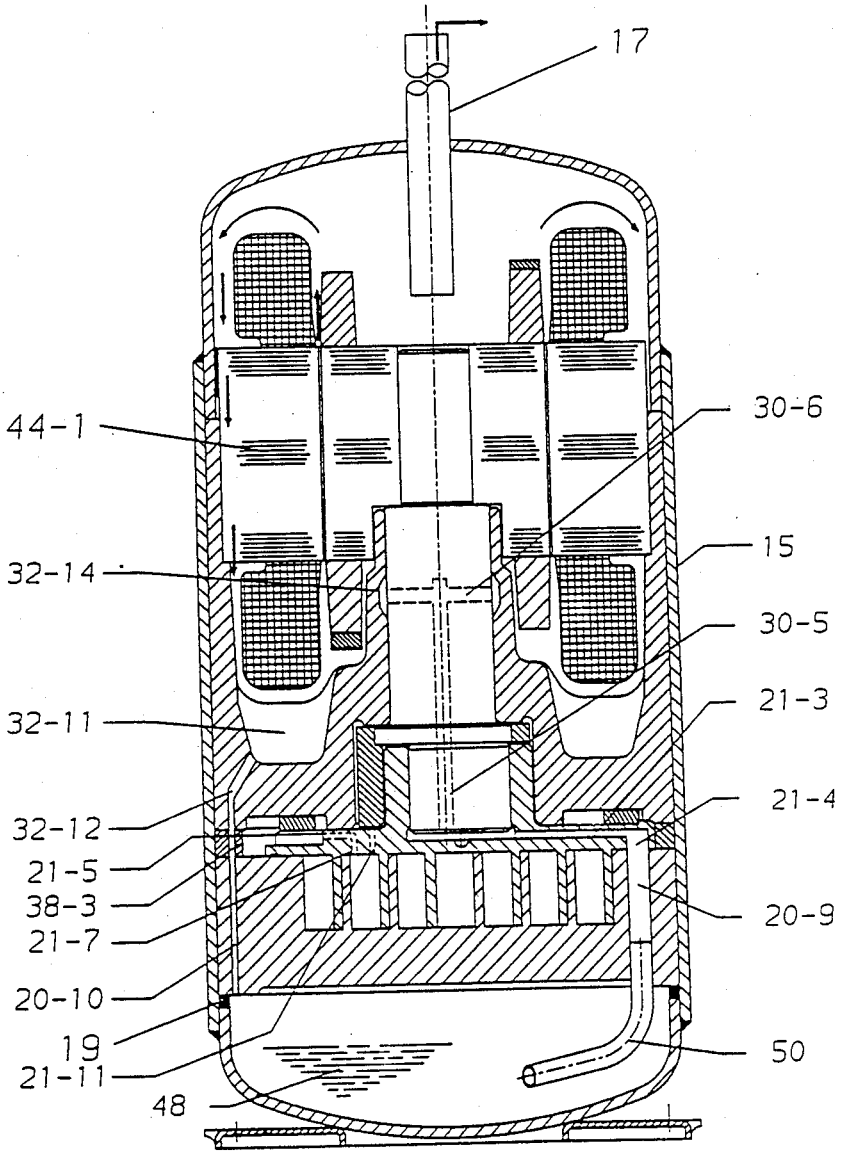
FIG. 20 is a vertical sectional view taken along a section corresponding to line 8—8 of FIG. 5.

Referring now to FIGS. 18-20, the numeral 14 generally designates a scroll compressor which has a three-piece shell 15 made up of top shell 15-1, middle shell 15-2 and bottom shell 15-3. Shells 15-1 to 3 are welded together such that top shell 15-1 and bottom shell 15-3 are partially within middle shell 15-2 and their ends define shoulders which serve to hold the compressor structure in place as will be explained below. Suction tube 16 and discharge tube 17 extend through and are suitably sealed to middle shell 15-2 and top shell 15-1, respectively, as by welding. Suction tube 16, additionally, is received in bore 20-6 of fixed scroll 20 and is sealed from the interior of shell 15 by O-ring 18 which is located in internal groove 20-7 in bore 20-6.

Eccentric 30-4 of crankshaft 30 is received in bore 21-2 of tubular boss 21-1 of orbiting scroll 21 and as shown in FIGS. 18–20, the end of eccentric 30-4 is in an enlarged portion of bore 21-2 and not in contact therewith so that edge effects are avoided. Crankshaft 30 and orbiting scroll 21 move as a unit with flange 30-3 and counterweight 34 in bore 32-4 while boss 21-1 is held to the orbiting motion of orbiting scroll 21. Flange 30-3 which is located between shoulder 32-2 and tubular boss 21-1 also serves as a thrust surface. Oldham coupling 36 is located in annular recess 32-8, radial grooves 21-12 and 13, and radial slots 32-6 and 7 so that Oldham coupling 36 coacts with orbiting scroll 21 and bearing head 32 in a conventional fashion to limit movement of orbiting scroll 21 to an orbiting motion. Spacer ring 38 is bolted between fixed scroll 20 and bearing head 32 by a plurality of assembly bolts 40 which have bolt seals 41 to prevent leakage along the threads of bolts 40. Spacer ring 38 prevents the tightening of bolts 40 to such an extent that movement of orbiting scroll 21 and Oldham coupling 36 is interfered with. As best shown in FIG. 19, spacer ring 38 has a pair of diametrically spaced, axially extending, recessed areas 38-1 and 2. If desired, spacer ring 38 may be made as part of bearing head 32 or fixed scroll 20. However, for manufacturing purposes, a separate spacer ring 38 is preferred since its thickness can be selected depending upon the thickness of the plate or disk of the orbiting scroll 21. With shaft 30, bearing head 32, orbiting scroll 21, spacer ring 38, Oldham coupling 36 and fixed scroll 20 bolted together by bolts 40 into the assembly described above, stator 44-1 of motor 44 is shrink fit into the bearing head 32 such that stator 44-1 engages annular shoulder 32-13 and is properly positioned thereby. As stator 44-1 is being fit into place, rotor 44-2 is shrink fit onto reduced shaft portion 30-1 of crankshaft 30. It will be noted that rotor counterweights 44-3 and 4 are provided on rotor 44-2 to offset the inertial forces and moment produced by the driving of orbiting scroll 21 and eccentric 30-4. It should be noted that orbiting scroll 21 is balanced so that its center of gravity is located along the axis of bore 21-2.

Oil pickup tube 50 is inserted into axial bore 20-9 in fixed scroll 20. The assembly of shaft 30, bearing head 32, orbiting scroll 21, spacer ring 38, Oldham coupling 36, fixed scroll 20 pickup tube 50 and motor 44 is then inserted in middle shell 15-2. Suction tube 16 is inserted through opening 15-4 in shell 15-2 past 0-ring 18 into bore 20-6 and is then welded or otherwise suitably secured in place. A gasket 19 is placed upon the machined lower surface of fixed scroll 20 and lower shell 15-3 is then inserted into middle shell 15-2 until it squeezes gasket 19 between shell 15-3 and fixed scroll 20 and is then welded or otherwise suitably secured to middle shell 15-2. Top shell 15-1 is then inserted into middle shell 15-2 until it engages sleeve portion 32-10 of bearing head 32 and is then welded or otherwise suitably secured to middle shell 15-2. Gasket 19 ensures the isolation of the discharge gas and lubrication oil. When assembly takes place as described, the internal compressor structure is secured and located in a manner easily executed in a manufacturing process.

Figure 5:
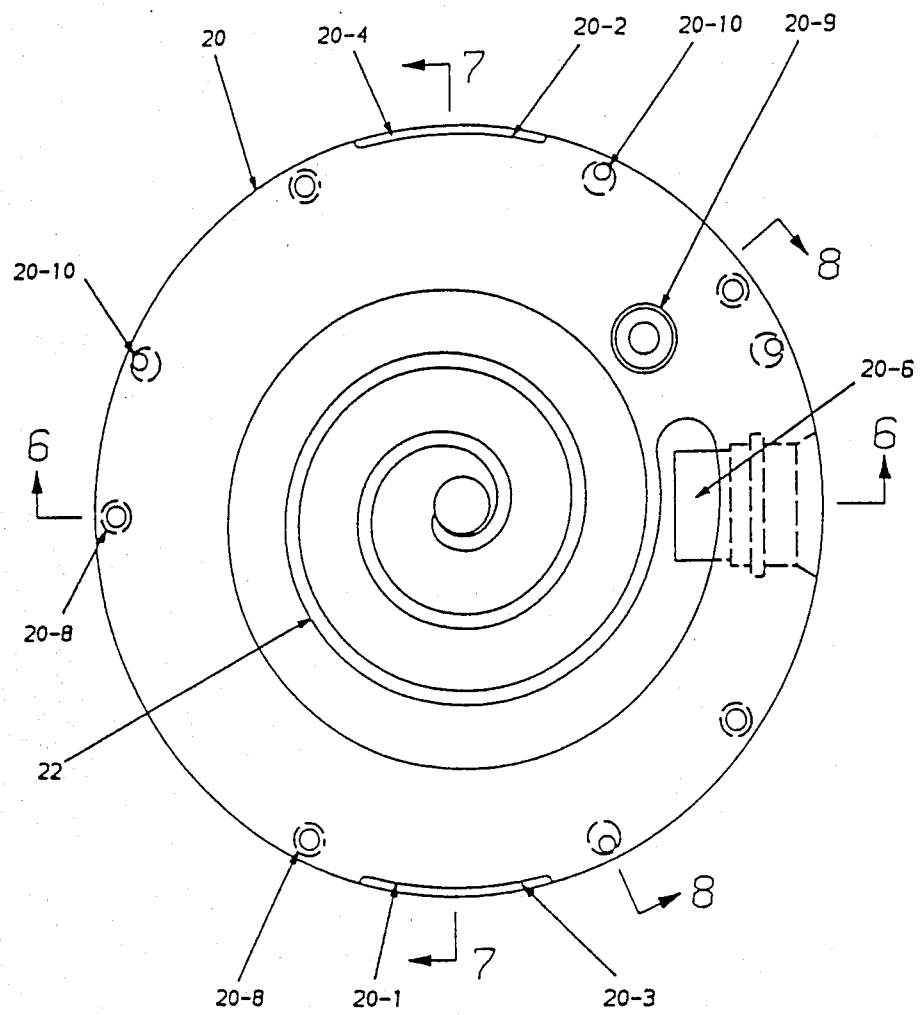
FIG. 5 is a top view of the fixed scroll.
Figure 6:
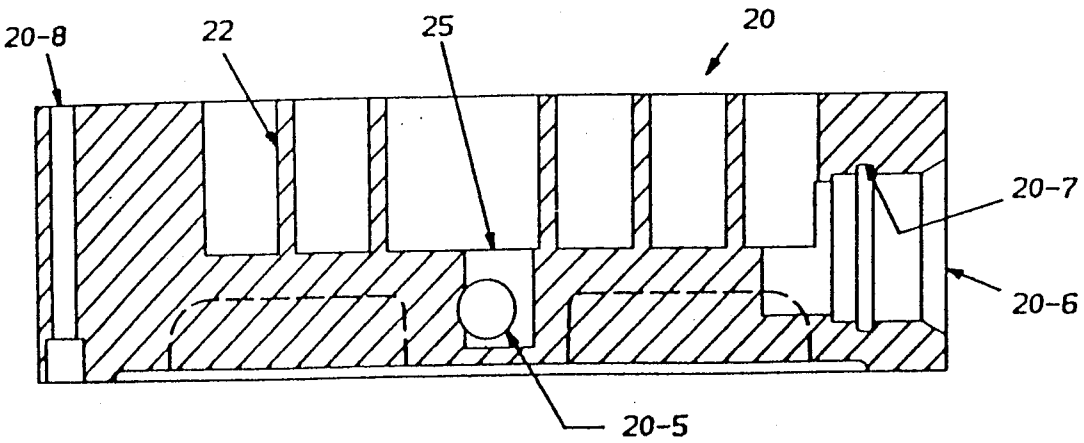
FIG. 6 is a sectional view taken along line 6—6 of FIG. 5.
Figure 10:
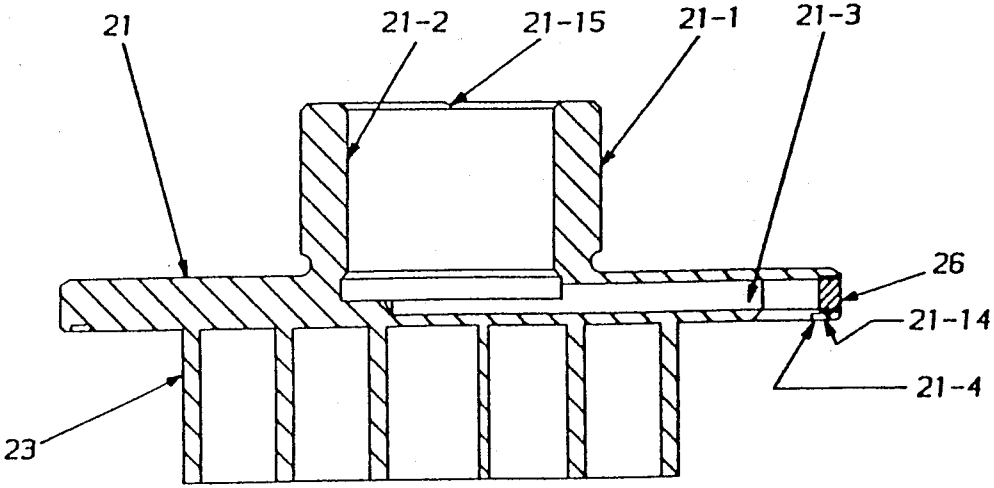
FIG. 10 is a sectional view taken along line 10—10 of FIG. 9.
Figure 11:
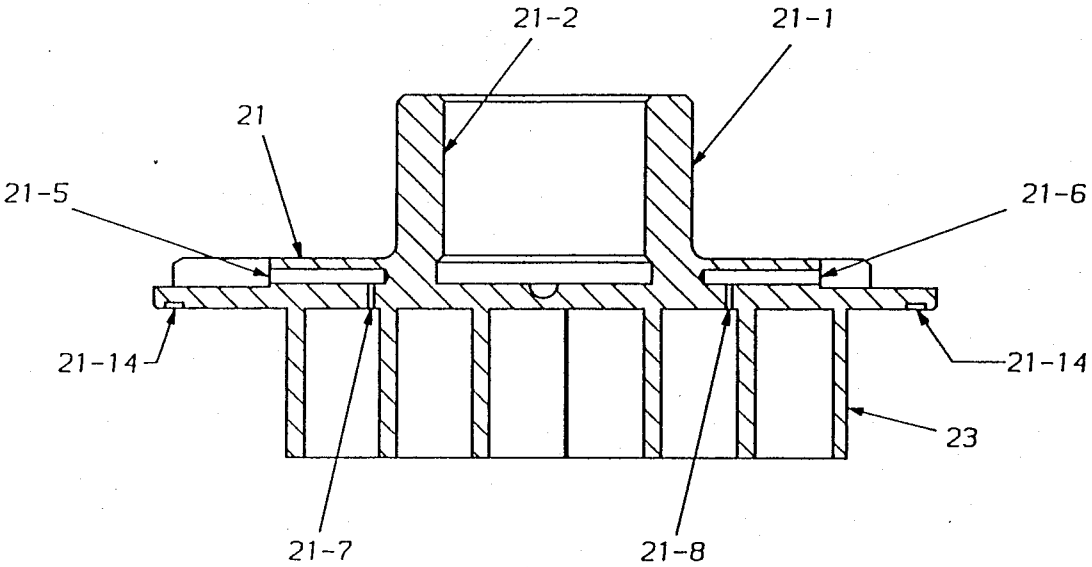
FIG. 11 is a sectional view taken along line 11—11 of FIG. 9.
Figure 12:
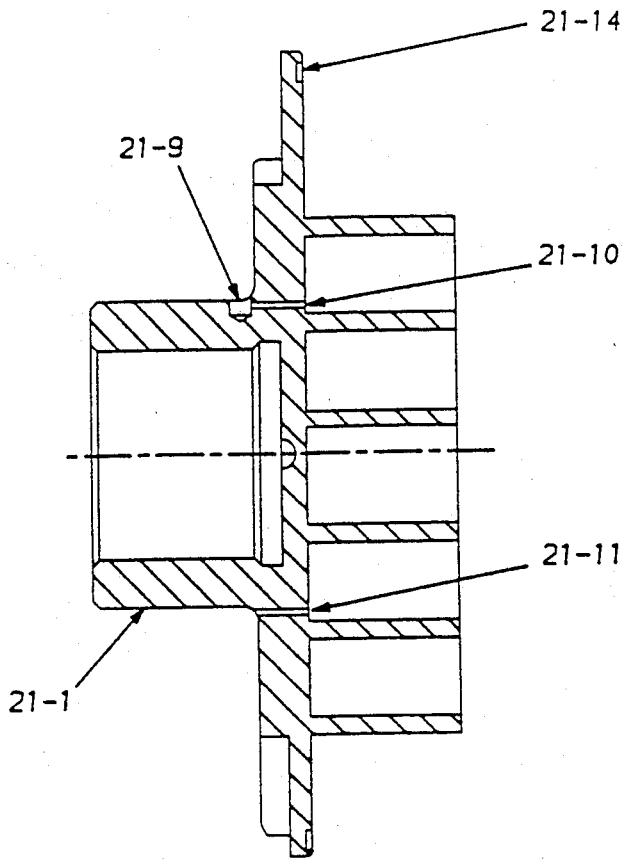
FIG. 12 is a sectional view taken along line 12—12 of FIG. 9.

In operation gaseous refrigerant is drawn into scroll compressor 14 via suction tube 16 and passes via bore 20-6 into the space surrounding wraps 22 and 23 as best shown in FIGS. 5 and 18. The gaseous refrigerant is compressed in the manner illustrated in FIGS. 1-4. Referring now to FIGS. 7 and 19, the compressed gaseous refrigerant is forced through discharge 25 into bore 20-5 where the flow divides. A first portion of the flow passes from bore 20-5 serially into the flow passage defined by the interior of middle shell 15-2 and recessed areas 20-1, 38-1 and 32-15 from which it passes through radial notch 32-17 and passes over stator 44-1 into discharge tube 17 which delivers the compressed refrigerant to the system. Similarly, the second portion of the flow passes from bore 20-5 serially into the flow passage defined by the interior of middle shell 15-2 and recessed areas 20-2, 38-2 and 32-16 from which it passes through radial notch 32-18 and passes over stator 44-1 into discharge tube 17. Since the middle shell has a large surface area exposed to ambient, this circulation of the compressed refrigerant in contact with shell 15 prior to discharge from the shell 15 effectively reduces the discharge gas temperature and thereby provides efficient cooling. Because the flow path requires flow over the rotating rotor 44-2, the gas and oil mist is effectively subjected to a centrifugal separation which removes oil from the compressed refrigerant gas delivered to discharge tube 17. The flow of refrigerant is indicated by the arrows in FIGS. 18 and 19. The centrifugally separated oil flows downwardly, as indicated by the arrows in FIG. 20, through the holes in the motor 44 (not illustrated) and the arc passages (not illustrated) on the outer diameter of stator 44-1 and the inner wall of sleeve portion 32-10 to recess 32-11. Since the interior of shell 15 is at compressor discharge pressure this pressure can be used in combination with the centrifugal pump defined by bores 30-5 and 6 in crankshaft 30 to deliver the lubricant. Specifically oil sump 48 which is defined by bottom shell 15-3 is at discharge pressure and oil pickup tube 50 extends beneath the surface of the oil. As long as this is true, oil will be delivered through tube 50 if it is connected to a region at less than discharge pressure. This also requires that the location of the inlet of the pickup tube be considered when the unit is located in other than an essentially vertical position. For example the inlet of the tube may have to be located at one side of the shell 15 which is the bottom when the compressor 14 is 20° from horizontal. Referring specifically to FIGS. 10 and 20, compressor discharge pressure acting on the oil in oil sump 48 forces oil into pickup tube 50 from which the oil serially passes through axial bore 20-9, axial bore 21-4 and radial bore 21-3 into the bottom of axial bore 21-2, beneath eccentric 30-4. Because of the movement of orbiting scroll 20, the bore 21-4 will be moving relative to bore 20-9 but they will remain in registration such that the oil flow path established therebetween continually exists. Additionally, bore 21-4 intersects annular groove 21-14 which provides lubrication for thrust bearing lubrication between fixed scroll 20 and orbiting scroll 21. Due solely to the pressure differential between the back of orbiting scroll which is at less than discharge pressure and discharge pressure acting on the sump, or in combination with centrifugal force of bore 30-6 a portion of the oil flows up bore 30-5 into bore 30-6 which acts as a centrifugal booster pump and then passes at increased head into the annular chamber defined by annular recess 32-14 and crankshaft 30 at a higher than compressor discharge pressure thereby providing a seal from the discharge gas. Oil flows upwardly and downwardly from the annular recess 32-14 to lubricate the crankshaft 30. Oil flowing upwardly flows through passages in the eccentric shaft and out of bearing head 32 and passes down the tubular portion 32-5 into annular recess 32-11 where it joins oil flowing by gravity after being centrifugally separated from the discharge gas as described above. The oil drains from annular recess 32-11 due to gravity via one or more oil drains 32-12 which are each serially connected through a bore 38-3 in spacer ring 38 and a bore 20-10 in fixed scroll 20 back to the oil sump 48. It should be noted that this is the only return path to the sump 48 and the compressed refrigerant passing through bore is prevented by gasket 19 from leaking into sump 48. Gasket 19 also prevents the leakage of oil back into the discharge passages if, for example, the oil sump level reached the rotor such as when there is refrigerant entrainment in the oil. Hence this compressor will safely operate fully submerged in oil.

The oil flowing downwardly from the annular recess 32-14 between crankshaft 30 and the eccentric shaft journal defined by bore 32-1 flows into upper intermediate pressure chamber which is at less than discharge pressure and is defined by bore 32-4 in which eccentric 30-4 and counterweight 34 rotate and boss 21-1 orbits. A portion of the oil supplied into the bottom of axial bore 21-2 flows through the oil clearance between eccentric 30-4, bore 21-2 and V-grooves 21-15 into the upper intermediate pressure chamber defined by bore 32-4. Oil entering the upper intermediate pressure chamber "flashes off" any entrained refrigerant. The upper intermediate pressure chamber defined by bore 32-4 is in a restricted fluid communication with annular lower intermediate pressure chamber defined by spacer ring 38 and annular recess 32-8 in which Oldham coupling 36 moves and orbiting scroll 21 orbits. The restriction between the chambers is defined by the coaction of face 32-9 with orbiting scroll 21. The oil in the upper intermediate pressure chamber defined by bore 32-4 serves to lubricate shoulder 32-2 flange 30-3 and counterweight 34 as it enters the chamber while providing a seal. If the thrust forces are properly balanced, shoulder 32-2 will not be loaded. Oil and the flashed refrigerant from the upper intermediate stage pressure chamber defined by bore 32-4 passes through bores 21-9 and 10 to be delivered to the wraps at one point and via bore 21-11 to be delivered to the wraps at a second point such that the oil provides a seal between the wraps 22 and 23 which confine compressed gaseous refrigerant at a pressure less than discharge. Oil also leaks between and thereby lubricates the contact area of face 32-9 and orbiting scroll 21 as it flows to the chamber defined by spacer ring 38 and annular recess 32-8 but the pressure is reduced from upper intermediate to lower intermediate pressure in going between the chambers. The lower intermediate pressure oil in the chamber defined by spacer ring 38 and annular recess 32-8 lubricates the Oldham coupling 36 and is delivered via bores 21-7 and 21-8 to the wraps at different points such that the oil provides a seal between the wraps which confine compressed gaseous refrigerant at a pressure less than the pressure at which oil is delivered via bores 21-10 and 11. Because bores 21-7,8,10 and 11 are in fluid communication with the gas being compressed between the wraps but which is at less than discharge pressure, this establishes a pressure differential with the oil sump which is at discharge pressure and provides the pressure differential necessary for oil flow.

Although the present scroll compressor 14 is operational when a single level of back pressure acts on orbiting scroll 21, by using dual back pressure chambers, the rotating action of counterweight 34 agitates the oil and thereby removes the refrigerant saturated in the oil. As a result of centrifugal force, oil moves away from the center of rotation and thus the separated gaseous refrigerant can be injected back into the scrolls along with the oil and thereby increase the efficiency. The remainder of the oil passes between the sealing surfaces defined by face 32-9 and orbiting scroll 21 into the lower intermediate pressure chamber defined by spacer ring 38 and annular recess 32-8 thereby lubricating the thrust surface and the Oldham coupling. The oil then passes into bores 21-5 and 6, and is injected into the scroll elements via bores 21-7 and 8, respectively. Since the axial forces are balanced by dual back pressures in the respective chambers, the pressure at the lower intermediate pressure is lower than the case where the whole back chamber is exposed to a single intermediate pressure. This reduces the pressure differential between the suction plenum and the lower intermediate back chamber and thereby reduces the tendency to leak.

Although a preferred embodiment of the present invention has been illustrated and described, other modification will occur to those skilled in the art. It is, therefore, intended that the present invention is to be limited only by the scope of the appended claims.

What is claimed:

1. A high side hermetic scroll compressor comprising:

casing means having an inlet and an axially extending discharge line extending therethrough;

a fixed scroll means within said casing means having a helical wrap formed therein with said wrap being in fluid communication with said inlet at its outer portion and having an axial discharge at its inner portion;

at least one radially extending discharge bore extending from said axial discharge to a corresponding recessed area in the outer periphery of said fixed scroll which together with said casing means forms a fluid path;

an orbiting scroll means within said casing means having a helical wrap on one side coacting with said wrap of said fixed scroll means to define a plurality of trapped volumes;

crankshaft means having two ends with one end operatively connected for causing movement of said orbiting scroll means;

bearing head means supporting said crankshaft means with the other end of said crankshaft means extending therethrough and including a sleeve portion;

motor means operatively connected to the other end of said crankshaft means for causing rotation thereof and including a rotor and a stator which are at least partially located within said bearing head means;

at least one recessed area in the outer periphery of said sleeve portion and together with said casing means forming a continuation of said fluid path defined between said fixed scroll means and said casing;

a radial notch in said sleeve portion in said recessed area forming continuation of said fluid path whereby said fluid part is diverted inwardly towards said motor means;

anti-rotation means coacting with said orbiting scroll means to limit said orbiting scroll means to orbiting motion with respect to said fixed scroll means;

an oil sump in said casing means;

means for lubricating said scroll compressor;

whereby in operation gaseous refrigerant passes through said inlet into said casing means and between said wraps which coact to established trapped volumes of refrigerant which are compressed and delivered to said axial discharge with at least some of the compressed refrigerant passing into a flow patch which serially includes said at least one radial extending discharge bore, said fluid path between said fixed scroll means and said casing means which are in thermal contact with ambient for heat exchange therewith and the continuation thereof defined between said sleeve portion and said casing, the flow then passing through said radial notch and said gaseous refrigerant passing over and thereby cooling said motor means before passing through said axially extending discharge line.

2. A high side hermetic scroll compressor comprising:

casing means having an inlet and an axially a fixed scroll means within said casing means having a helical wrap formed therein with said wrap being in fluid communication with said inlet at its outer portion and having an axial discharge at its inner portion;

at least two, spaced, radially extending discharge bores extending from said axial discharge to recessed areas in the outer periphery of said fixed scroll which together with said casing means form fluid paths;

an orbiting scroll means within said casing means having a helical wrap on one side coacting with said wrap of said fixed scroll means to define a plurality of trapped volumes;

crankshaft means having two ends with one end operatively connected for causing movement of said orbiting scroll means;

bearing head means supporting said crankshaft means with the other end of said crankshaft means extending therethrough and including a sleeve portion;

motor means operatively connected to the other end of said crankshaft means for causing rotation thereof and including a rotor and a stator which are at least partially located within said bearing head means;

at least two recessed areas in the outer periphery of said sleeve portion and together with said casing means forming a continuation of said of said fluid paths defined between said fixed scroll means and said casing;

a radial notch in said sleeve portion in each of said recessed areas forming a continuation of said fluid paths whereby said fluid paths are diverted inwardly towards said motor means;

anti-rotation means coacting with said orbiting scroll means to limit said orbiting scroll means to orbiting motion with respect to said fixed scroll means;

an oil sump in said casing means;

means for lubricating said scroll compressor;

whereby in operation gaseous refrigerant passes through said inlet into said casing means and between said wraps which coact to established trapped volumes of refrigerant which are compressed and delivered to said axial discharge with the compressed refrigerant dividing into a plurality of flows each of which serially includes one of said radial extending discharge bores, the corresponding one of said fluid paths between said fixed scroll means and said casing means which are in thermal contact with ambient for heat exchange therewith and the continuation thereof defined between said sleeve portion and said casing, the flow then passing through the corresponding one of said radial notches and said gaseous refrigerant passes over and thereby cools said motor means before passing through said axially extending discharge line.

3. The scroll compressor of claim 2 wherein said axially extending discharge line is essentially vertical and said motor means in operation acts as a centrifugal separator for removing oil from said gaseous refrigerant passing over said motor means.

4. The scroll compressor of claim 3 wherein said bearing head means includes means for collecting said separated oil and further including means for directing said collected oil to said oil sump.

* * * * *